United States Patent [19]

Zeilenga

[11] Patent Number: 4,672,746

[45] Date of Patent: Jun. 16, 1987

[54] PROTECTIVE MECHANISM FOR CIRCULAR SAWS

[76] Inventor: Christopher Zeilenga, P.O. Box 265, South Holland, Ill. 60473-0265

[21] Appl. No.: 861,063

[22] Filed: May 8, 1986

[51] Int. Cl.[4] ..... B27G 19/04

[52] U.S. Cl. ..... 30/391; 83/478

[58] Field of Search ..... 30/373, 390, 391, 388; 83/478, 544, DIG. 1

[56] References Cited

U.S. PATENT DOCUMENTS

| | | | |
|---|---|---|---|
| 1,811,577 | 6/1930 | Crowe . | |
| 1,813,231 | 7/1931 | Crowe | 30/391 |
| 1,850,444 | 3/1932 | Brumell . | |
| 2,659,399 | 11/1953 | Doug . | |
| 2,801,654 | 8/1957 | Utz . | |
| 3,177,909 | 4/1965 | Laube . | |
| 3,441,067 | 4/1969 | Forcier | 30/391 |
| 3,787,973 | 1/1974 | Beisch et al. | 30/391 |

*Primary Examiner*—Frank T. Yost
*Assistant Examiner*—Michael D. Folkerts
*Attorney, Agent, or Firm*—Willian Brinks Olds Hofer Gilson & Lione Ltd.

[57] ABSTRACT

In a hand-held circular power saw, a mechanism whereby a blocking pawl moves into the path of a projection fixed to the rotatable blade guard of the saw, preventing motion of the blade guard and protecting the operator. The blocking pawl is moved into the blocking position during the opening of the blade guard, when the projection fixed to the blade guard tangentially forces a cam-shaped surface to rotate, the cam-shaped surface thereby forcing the blocking pawl into the return path of the blade guard projection. The pawl is kept in this position by means of a spring biased arm which is forced against a toggle such that motion of the lever is prevented.

10 Claims, 8 Drawing Figures

FIG. 1
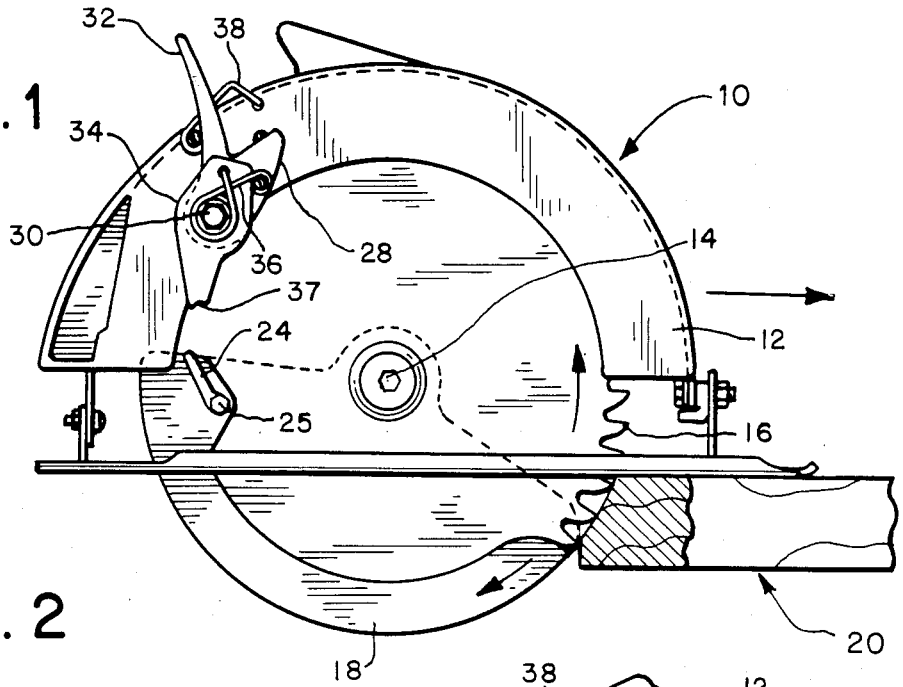
FIG. 2
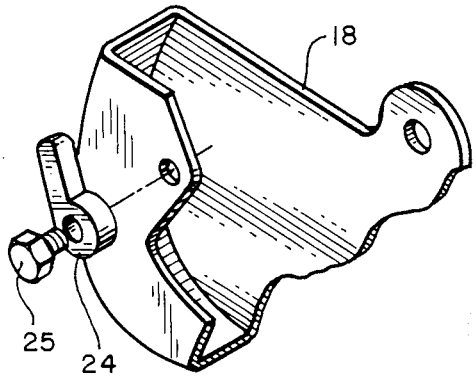
FIG. 3
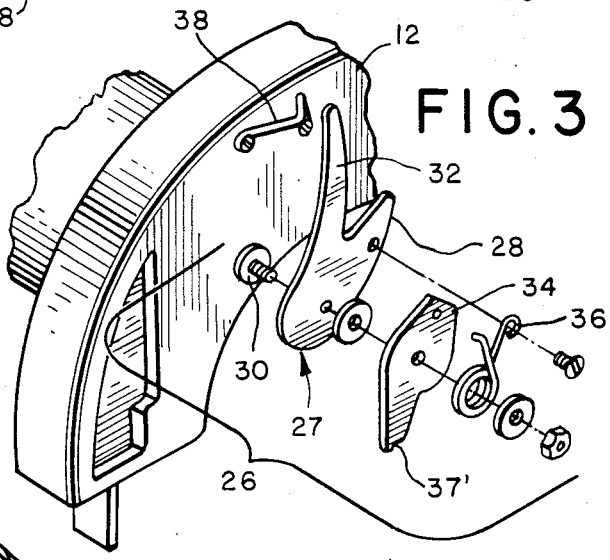
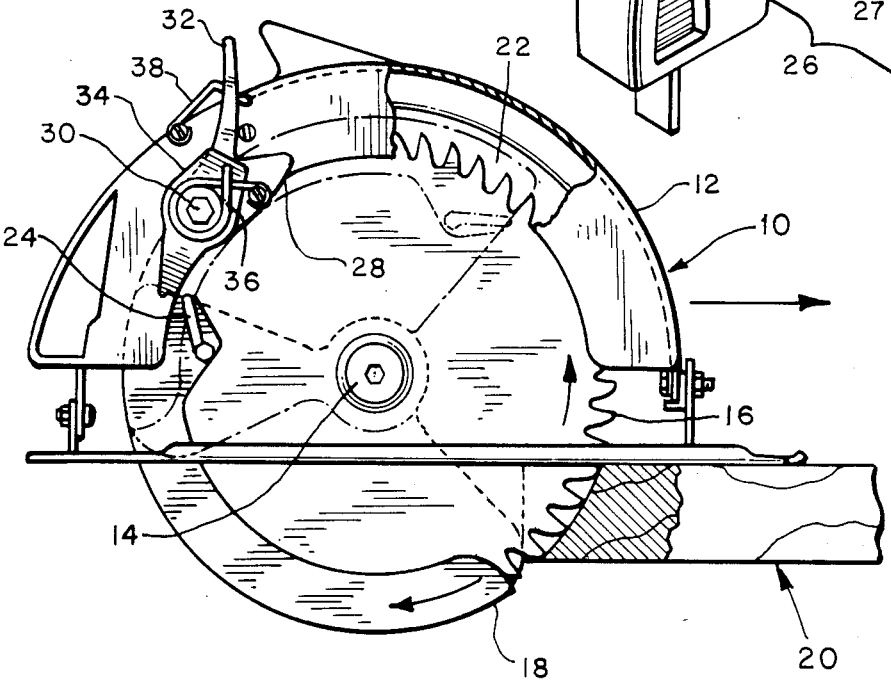
FIG. 4

PROTECTIVE MECHANISM FOR CIRCULAR SAWS

FIELD OF THE INVENTION

This invention encompasses protective guards for rotary blades on circular saws. The invention may also be used to protect any operation using a hand held power tool with an exposed cutting edge.

BACKGROUND OF THE INVENTION

Hand held power tools are quite commonly used today, both by workers in various fields of industry and by individuals employing such tools for home use, as well as for hobbies. Such hand-held tools have inherent, although correctable, dangers. For instance, hand-held circular power saws have a saw blade which must necessarily be exposed in order to perform a cutting operation. These saws are generally activated by the operator depressing a finger trigger-type switch within the handle. At times, although not making a cut, the exposed blade will still rotate due to the operator's continued grip of the trigger on the saw handle. Serious harm results with contact between the blade and the operator's body. For this reason, saw manufacturers have placed rotatable blade guards on virtually all the hand held circular saws in use today. These rotatable guards are spring energized, biased to close the guard over the saw blade. When force is placed on the guard, for instance through contact with a workpiece, the rotary blade is exposed, The guard will then telescope into a preformed chamber surrounding the saw blade.

The rotatable guard has an inherent deficiency as it presently exists. It is the object of this invention to eliminate this deficiency without destroying the saw's utility. The deficiency lies in the fact that the saw blade can be exposed, with risk of injury to the operator, as a consequence of an unintended guard reopening. Previous guards were designed to open whenever the saw was advanced upon the workpiece. Those guards, however, will also open if the saw is unintentionally advanced upon any part of the operator's body. This can and does happen when a kickback occurs, causing the operator to lose control over the saw, allowing the saw to come in contact with the operator's body causing reopening of the guard. During such an occurrence the blade continues to rotate under power since the operator invariably maintains or increases his grip on the saw's handle, with his finger on the switch trigger, as he attempts to maintain control over the saw. The present invention controls this reopening of the blade guard which, in turn, controls the exposure of the saw blade and thereby prevents injury to the operator.

Two previous references of which the inventor is aware have dealt with the problem of the blade guard on a saw. U.S. Pat. Nos. 1,811,577 (Crowe) and 1,813,231 (Crowe) both contain a blade guard which is spring loaded to cover the exposed blade of a circular saw. Yet, both inventions do not encompass the rotatable guards present in modern circular saws. Nor do these inventions contain a mechanism which ensures that the blade guard continues to cover the saw blade once kickback has occurred and the spring loaded guard has returned to its protective position.

SUMMARY OF THE INVENTION

The present invention contains a latching mechanism connected at any point on the stationary part of the saw surrounding the blade and an activating means which is attached to the rotating blade guard. The latching mechanism typically consists of two pieces. First there is an operating lever which has an operator arm and a cam leg. This operating lever has two distinct positions. One is a "latched" position and the other is an "unlatched" position. The operating lever is physically held at either position by any suitable means such as, but not limited to, detents, toggles, ball and ramp, magnets etc. The operator arm of this operating lever is used by the operator to "unlatch" the mechanism prior to each cut. The cam leg of this operating lever is actuated by the blade guard to reset the latch mechanism to the "latch" position for the next cut, as the blade guard begins to open for the cut about to be made.

Although the descriptions contained herein describe the operating lever as a one piece item, it does not have to be so constructed. The only necessity is that the operating lever be constructed to provide the operator with a means to unlatch the mechanism for the purpose of permitting the guard to open, and providing a means by which the motion of the guard, as it begins to open, can reset the mechanism so that the guard will latch as it returns to its closed position.

Second, a pawl is incorporated within the latch mechanism. The pawl's fundamental purpose is to block the blade guard, preventing the blade guard's opening when in the latched position; the pawl also allows the blade guard to return to its closed position. The pawl is retracted from its blocking position when the operating lever is placed, by the operator, into the unlatched position. The guard is thereby allowed to open when a cut is made. The pawl pivots through a small arc about a pivot point, which may be common with the operating lever. The pawl is spring biased to the limit of its arc of travel in the direction which is associated with blocking. The pawl spring force is insufficient to influence the position of the operating lever. Its permissable arc of travel is sufficient to allow the guard projection to move past as it forces the pawl out of its path, against the effort of the pawl biasing spring. This occurs as the guard returns to its closed and blocked position. The position of the operating lever positions the pawl in the blocking position, or retracts it from that position. The operating lever and blocking means are usually rotatably mounted to the stationary section of the saw adjacent to the rotatable blade guard. Both the operating lever and the blocking means will usually pivot about the same point.

The activating mechanism consists of a projection, which may be an integral part of the rotatable blade guard. This projection is aligned so that when the blade guard is rotated, it moves tangentially along the cam leg of the operating lever, which causes the operator arm of that mechanism to move to its latched position. In addition, this motion causes the pawl of the blocking member to move into the path of the projection on the rotatable guard. When the blade guard rotates back to its initial position, at the end of making a cut or during a kickback, the projection on the rotatable guard forces the pawl on the latching mechanism away from the blade guard, permitting rotation of the blade guard to the closed position. The spring mechanism which biases the pawl, forces the pawl back into the path of the projection on the rotatable guard. Thus when the blade guard attempts to reopen, for any reason, the projection is blocked by the pawl, and motion is thereby prevented. The blade stays covered, and injury is avoided.

In a second embodiment, the blade guard also has a handle attached to it. This handle enables the operator to manually operate the blade guard so that during a cut the pawl on the handle comes into contact with the unlatched operator lever, and the cam leg causes the operator arm to move to its latched position, again preventing reopening.

In another embodiment, the latching means, that is, the operator arm, the cam leg and the blocking pawl, are all contained in one piece and rotatable about the same axis on the stationary part of the saw. In this mechanism, the guard handle is rotatably mounted instead of rigidly fixed as before, and is spring biased to place the path of travel of a pawl attached to the handle in line with the blocking means of the operating lever in the "latched" position. The rotatable handle and its pawl have a very limited arc of travel about the pivot point on the blade guard. When the rotatable handle manually opens the guard, it pivots to the limit of its arc of travel sufficient to position the pawl attached to the handle out of the path of the blocking means of the operating lever. Thus, when manual opening of the guard by use of the handle is being performed, it is unnecessary to "unlatch" by use of the operating lever. However, when the manual handle is not used, it becomes necessary to "unlatch" by means of the operating lever permitting the blade guard to open automatically as the saw is advanced onto the workpiece. Under either condition the cam leg of the operating lever is positioned to be forced back to its "latched" position by a stationary projection on the rotatable blade guard, just as in the first embodiment.

DESCRIPTION OF THE DRAWINGS

FIG. 1 is a side elevation of the present invention in the latched position, preventing motion of the blade guard.

FIG. 2 is an exploded view in perspective of a portion of the blade guard and projection.

FIG. 3 is an exploded view in perspective of the latching mechanism attached to the stationary part of the saw.

FIG. 4 is a side elevation partially in cross section of the present invention in the unlatched position, allowing motion of the blade guard.

DETAILED DESCRIPTION

Figure 5:
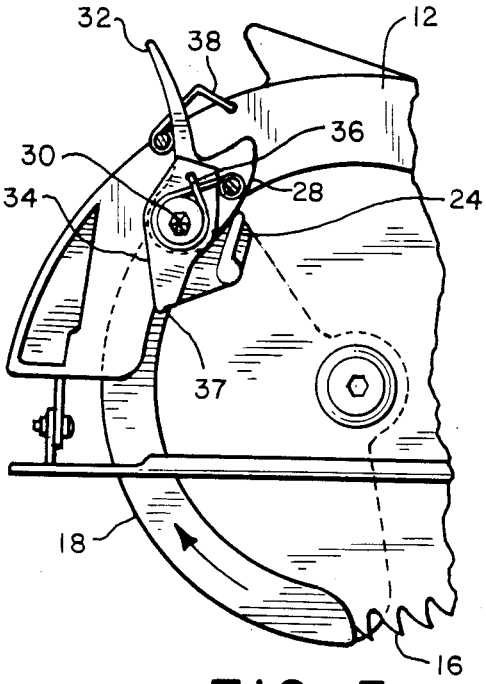
FIG. 5 is a side elevation of the present invention, with tangential contact between the cam leg and the activating means.
Figure 6:
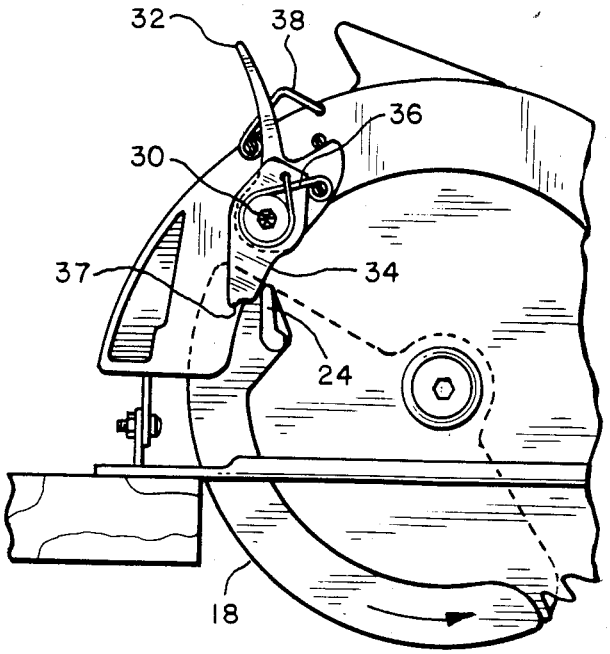
FIG. 6 is a side elevation of the present invention, with tangential contact between the activating means and the blocking means.

As seen in FIG. 1, in a circular saw 10 there will generally be a stationary section 12 which contains a housing for the motor not shown, and the shaft 14 extending from the motor or its driven shaft upon which the circular saw blade 16 is mounted. When the shaft rotates, the blade does so with it and a cut may be made. In addition, there will generally be a rotatable guard 18 covering the saw blade. This guard is spring loaded, by a spring not shown, so that when no force is exerted on it, the guard covers the exposed saw blade and thereby prevents injury. Force is exerted on the blade guard 18 in a direction parallel to the cut being made by the guard 18 coming into contact with the workpiece 20. When this contact occurs, the guard 18 telescopes into a performed chamber 22 as best seen in FIG. 4 in the stationary section 12 of the saw 10 surrounding the saw blade 16, and the spring connected to the blade guard 18 is tensioned. When the force against the guard ceases, the guard 18 again returns to its unforced position. As seen in FIG. 2, on this rotating guard 18 is a projection 24, an integral part of the guard 18, or rigidly fixed by a pin 25. This projection 24 will generally be a piece of machined metal. It is mounted so that the projection 24 remains generally tangent to the arc described by the motion of the rotating guard 18.

As seen in FIG. 3, the latching mechanism 26 is mounted on the stationary part 12 of the circular saw 10. This mechanism is generally composed of two pieces and their connecting parts. There is an operating lever 27 consisting of a leg with a cam surface 28 and an operator arm 32 serving as a manual operator. As a unit it is rotatably mounted on a pin 30, and positioned so that the cam leg 28 can be moved into the path of the projection 24 described by the arcuate motion of the rotating guard 18. The operator arm 32 of the operating lever 27 and the cam leg 28 are secured together. As seen in FIG. 3, the cam leg 28 and the operating arm 32 are generally formed from one piece 27, constructed as an L-shape. As a unit the operator arm 32 is mounted on pin 30 and rotates with the cam leg 28. The operator arm 32 and cam leg 28, if not part of the same piece of material, are nevertheless connected together to act as a unit so that rotation of the cam leg 28 away from the path of the blade guard 18 will cause rotation of the operator arm 32 to its latched position. The second member of the latching mechanism 26 is the blocking means 34. This blocking means 34 will generally constitute a spring loaded pawl. At least one surface 37 of this piece will be planar, so that is is formidable enough to block the motion of the projection 24 mounted on the blade guard 18. The blocking section 34 is also shown pin-mounted to pin 30 so that it rotates about the same axis as the operating lever 27 consisting of the operator arm 32 and the cam leg 28, although this concurrence of axes is not necessary. It is connected to the operating lever by means of a spring 36. As seen in FIG. 1, when the cam leg 28 has moved away from the path of the projection 24 on the rotating blade guard 18, causing the operator arm 32 to move in the same direction as the cam leg 28, the planar surface 37 of the blocking section 34 is caused to move into the path of the projection 24 on the blade guard 18 due to the tension of the spring 36 which biases the blocking section 34 to one limit of its possible arc of travel.

Back to FIG. 3, the piece which completes the latching mechanism is the toggle 38 located on the stationary part 12 of the saw 10 toward the end of the operator arm 32. It is this toggle 38, generally in the form of a detent, which keeps the mechanism in an unlatched (unprotective) or latched (protective) position. As seen in FIG. 1, the operator arm 32 has been moved into the protecting latched position by being placed on one side of the toggle 38. As seen in FIG. 4, the operator arm 32 is now in the unlatched, unprotective position, on the opposite side of the toggle 38. When in this initial unlatched position, the operator arm 32 sits to the side of the toggle 38 which causes the blocking section 34 to be out of the arcuate path of the projection 24.

The protective mechanism operates as follows. As in FIG. 1, initially the guard 18 is closed, surrounding the saw blade. The operator arm 32 must be moved to the unlatched position as in FIG. 4, causing the blocking pawl 34 to be out of the path of the projection 24 on the rotatable guard 18. The cam leg 28 is, however, caused to be in path of the projection 24. When the saw is advanced to make a cut, the guard 18 rotates and telescopes into the circular chamber 22 created in the stationary piece 12 of the saw 10. This causes the projection 24 on the guard 18 to begin its rotation tangential to the arc described by the rotation of the guard 18. As seen in FIG. 5, during this rotation, as the guard begins to open the projection 24 comes into tangential contact with the cam leg 28 of the latching mechanism 26. The projection 24 causes the cam leg 28 to move out of its path, the cam leg 28 rotating about the pin joint 30 to which it is connected. With the rotation of the cam leg 28, the operator arm 32 is also rotated. This force on the operator arm 32 is sufficient to overcome the force exerted on the operator arm 32 at the toggle 38. This force causes the latching mechanism to return to its latched position. The rotation of the cam leg 28 causes the spring-biased blocking pawl 34 to move into the path of the rotatable guard 18 with its projection 24. This position is best seen in FIG. 1. It should be recognized that the projection 24 moves past the cam leg 28 as the guard 18 is in the process of opening.

When the cut is finished, or when kickback occurs, the spring force on the guard 18 causes it to begin to rotate back to a position covering the saw blade. As seen in FIG. 5, as the rotatable blade guard closes, the projection 24 on the blade guard 18 comes into contact with the blocking pawl 34. However, because the blocking pawl 34 is rotatable about its pivot 30 and spring-mounted by the spring 36 to the operating lever 27 of the latching mechanism 26, the projection 24 causes the blocking pawl 34 to move out of its path, against the force of its biasing spring, permitting guard 18 to pass by. The spring 36 connecting the blocking mechanism 34 and the cam leg 28 is further compressed, but does not create a force sufficient to push the operator arm 32 across the toggle 38 into the unlatched position.

Once the projection 24 on blade guard 18 passes the blocking pawl 34, the biasing force of the pawl spring forces the blocking pawl 34 to snap back into the path of the projection 24 on the blade guard 18, while the operator arm 32 of the latching mechanism 26 remains in the latched position as best seen in FIG. 1.

Therefore, should the blade guard 18 rebound or should it attempt to move from its fully closed position and begin to rotate into the chamber 22 of the stationary part 12 of the saw 10, the projection 24 on the blade guard 18 comes into generally perpendicular contact with surface 37 of the blocking pawl 34 on the latching mechanism 26. Further motion of the blade guard 18 is prevented, and injury is avoided. An additional cut is possible only by moving the operator arm 32 past the toggle 38 and into the unlatched position as in FIG. 4.

Figure 7:
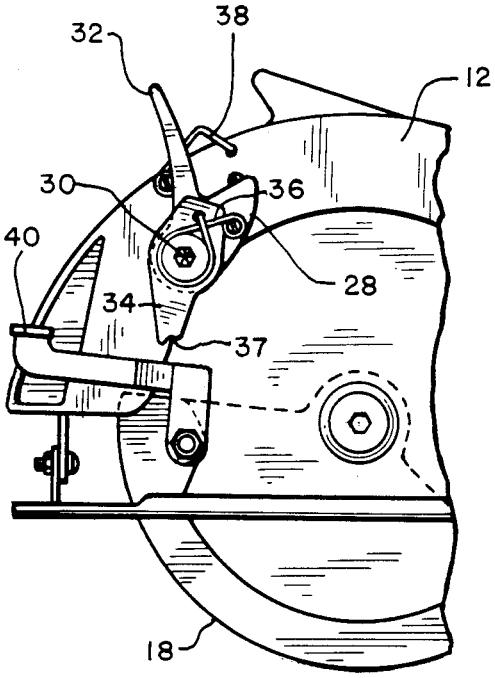
FIG. 7 is a side elevation of an alternate embodiment of the present invention, which has a handle attached to the activating means.
Figure 8:
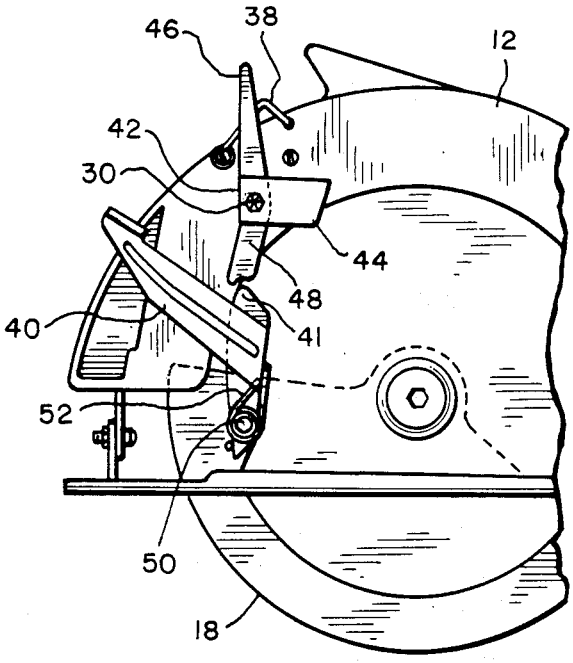
FIG. 8 is a side elevation of an additional alternate embodiment of the present invention, with a one-piece latching means and a spring biased manual handle, with pawl, and a rigidly fixed activating means.

Two other embodiments of this invention are described in FIG. 7 and FIG. 8. In FIG. 7, the projection mounted onto the blade guard 18 has been supplemented with a handle 40. This handle 40 is also rigidly mounted to the blade guard 18, and operates similarly to the projection 24 in FIGS. 1–6.

In FIG. 8, the latching piece 42 has replaced the latching mechanism 26 of FIGS. 1–7. This latching piece 42 is a one-piece combination composed of a cam leg 44, operator arm 46 and blocking means 48. This latching piece 42 is also rotatably mounted to the pin 30. Yet, because it is one piece, motion by one member of piece 42 causes motion of the remaining two members. Thus, if cam leg 44 has been moved out of the path of the pawl 41 of handle 40, the blocking means 48 will move into the path of the same pawl of handle 40, and the operator arm 46 will move across the toggle 38 from its unlatched position to its latched position. The handle 40 is pivotably mounted on a pin 50 and biased by a circular spring 52. This spring 52 forces the handle 40 to pivot into a position where the pawl 41 will come into generally perpendicular contact with the blocking means 48. On the other hand, the permissible arc of travel about pin 50 allows the pivoting of the handle 40 to cause the pawl 41 to move out of the path of the blocking means 48 during motion by the blade guard 18 to a position where it covers the saw blade 16. The spring 52 forces the handle 40 with its pawl 41 to its original position once it has passed the blocking means 48.

What I claim is:

1. A protective mechanism on a circular saw, the saw having a stationary section and a blade guard section rotatable about a circular saw blade, such protective mechanism comprising a latching means attached to said stationary section of the saw, said latching means having an unlatched position established by the operator, and a latched position, an activating means connected to the rotatable blade guard section, such that during the cutting process, as the rotatable guard opens, said activating means comes into contact with said latching means, said activating means causing said latching means to move from its unlatched position to its latched position, said latching means in its latched position thereby preventing motion of said rotatable blade guard after it has reclosed, such that at the end of the cutting process manual unlatching is required to restart the cutting process.

2. In the protective mechanism of claim 1, said latching means comprising a cam leg exposed to said activating means and an operator arm movable between the latched and unlatched positions and attached to said cam leg, such that when said activating means comes into contact with said cam leg, said cam leg forces said operator arm from its unlatched position to its latched position.

3. In the protective mechanism of claim 2, said latching means further comprising a toggle, such that when said operator arm is in its latched position, said toggle prevents said operator arm from moving to its unlatched position without external manual force.

4. In the protective mechanism of claim 2, said activating means comprised of a rigid projection, said projection being fixed to said rotating blade guard, said projection of said activating means rotatable to a generally tangential position with said cam leg of said latching means, such that when said rotating blade guard is rotated about the saw blade during the cutting process, said projection comes into contact with said cam leg, causing said cam leg to force the operator arm of the latching means to move to its latched position.

5. In the protective mechanism of claim 4, said latching means further comprising a blocking means connected to said latching means, such that when said operator arm is in the latched position, said blocking means prevents motion of the projection of said rotatable blade guard from its closed position.

6. In the protective mechanism of claim 5, said blocking means comprising a pawl attached to said arm and said cam leg and biased by means of a spring, such that when said operator arm passes into its latched position, said pawl moves into the path of the projection of said activating means, and when said projection rotates past said pawl by motion of the blade guard returning to its closed position at the end of the cutting process, said pawl permits the return motion of said projection attached to said blade guard, but will not permit motion of said projection to move in the direction travelled when said blade guard opens, keeping said blade guard in a position to cover said circular blade, thereby protecting the operator.

7. In the protective means of claim 6, said pawl of said blocking means comprising a section of rigid material attached to said cam leg by means of a pin and circular spring combination such that when the operator arm is in its latched position, said spring forces motion of said section of rigid material into the path of rotation of the projection fixed to the rotatable blade guard.

8. In the protective means of claim 4, said activating means further comprising a handle, rigidly fixed to said rotating blade guard, said handle enabling the operator to move said activating means along the said blade guard past said latching means during the cutting process.

9. In the protective mechanism of claim 2, said activating means comprising a handle attached to said blade guard by means of a pin and spring combination, said handle enabling the operator to move said blade guard past said latching means during the cutting process.

10. In the protective mechanism of claim 9, said blocking means, operator arm and cam leg formed from a singular piece of rigid material and fixed to the stationary part of the saw by means of a pin such that when in the latched position, the blocking means moves into the path of the projection of the activating means, thereby preventing motion of the blade guard.

* * * * *

UNITED STATES PATENT AND TRADEMARK OFFICE

CERTIFICATE OF CORRECTION

PATENT NO. : 4,672,746

DATED : June 16, 1987

INVENTOR(S) : Christopher Zeilenga

It is certified that error appears in the above-identified patent and that said Letters Patent is hereby corrected as shown below:

IN THE BACKGROUND OF THE INVENTION

In column 1, line 31, delete "exposed," and substitute therefor --exposed.--.

IN THE DETAILED DESCRIPTION

In column 4, line 9, delete "performed" and substitute therefor --preformed--.

IN THE CLAIMS

In Claim 8 (column 8, line 8), delete "the said" and substitute therefor --with said--.

Signed and Sealed this

Nineteenth Day of April, 1988

*Attest:*

DONALD J. QUIGG

*Attesting Officer*

*Commissioner of Patents and Trademarks*